US007101248B2

(12) United States Patent
Chiang

(10) Patent No.: US 7,101,248 B2
(45) **Date of Patent: *Sep. 5, 2006**

(54) AQUATIC FUN TOY

(76) Inventor: Herman Chiang, 11F-2 No. 634-9 Ching-Ping RD., Chung-Ho City, Taipei Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/037,370

(22) Filed: Jan. 19, 2005

(65) Prior Publication Data

US 2006/0160461 A1 Jul. 20, 2006

(51) Int. Cl.
*A63H 23/00* (2006.01)
*B63B 22/18* (2006.01)

(52) U.S. Cl. ..... 446/153; 441/23

(58) Field of Classification Search ..... 446/153, 446/156, 161, 491, 404, 220, 71; 441/6, 441/23; 273/350, 459; 473/466
See application file for complete search history.

(56) References Cited

U.S. PATENT DOCUMENTS 2,791,062 A * 5/1957 Hirsch et al. ..... 446/156
4,563,161 A * 1/1986 Zimmerman ..... 446/156
4,976,641 A * 12/1990 D'Amico ..... 441/23
5,516,316 A * 5/1996 Rumminger ..... 441/1
6,332,822 B1 * 12/2001 Greenberg et al. ..... 446/153
6,431,931 B1 * 8/2002 Johnson ..... 441/6
6,913,505 B1 * 7/2005 Chiang ..... 446/153

* cited by examiner

*Primary Examiner*—Faye Francis
(74) *Attorney, Agent, or Firm*—Troxell Law Office, PLLC

(57) ABSTRACT

An aquatic fun toy for an aquatic game including a buoyant body having an upper and a lower surface and a receiving portion communicating through the upper and lower surface, an underwater member receivable in the receiving portion and a plurality of supporting portions for supporting the buoyant body at a predetermined height above a bottom of water. A first engaging portion formed on the receiving portion and second engaging portion formed on the underwater member is engageable and disengageable with the first engaging portion. In use, the buoyant body engages the underwater member and sinks in water such that the supporting portions keep the buoyant body at a predetermined height above the bottom of the water, and when the underwater member is separated from the buoyant body, said buoyant body floats to the surface of the water and the underwater member remains immersed.

12 Claims, 5 Drawing Sheets

AQUATIC FUN TOY

FIELD OF THE INVENTION

The present invention relates to a fun toy, and particularly to an aquatic fun toy having a buoyant body for floating on water after the fun toy is depressed at an underwater member.

BACKGROUND

Swimming is not only one kind of wonderful sports but also one kind of activities for taking a summer holiday. More and more aquatic games are made and designed for fun, such as holding one's breath under water, walk race in water, treasure hunt under water, ball games in water and so on.

A conventional game of treasure hunt under water is that a coin is thrown in water and swimmers dive into water to look for the coin. The guy who first finds the coin is the winner. However, it is monotonous to look for a coin under the water and it is inconvenient to pick up a coin under the water since the coin is quite small.

SUMMARY OF THE INVENTION

Accordingly, an object of the present invention is to provide an aquatic fun toy, which is used for an aquatic game that combines the features of diving sport and amusement, and is a much vivid and funny aquatic fun toy.

To achieve the above-mentioned object, an aquatic fun toy in accordance with the present invention includes a buoyant body and a underwater member wherein first engaging portion formed on the receiving portion and second engaging portion formed on the underwater member which are engageable or disengageable with each other and a plurality of supporting portions positioned on the buoyant body.

In use, the buoyant body engages the underwater member and sinks in water such that supporting portions keep the buoyant body at a desired height above the bottom of water, and when the underwater member is depressed to disengage from the buoyant body thereby said buoyant body floats to the surface of the water and the underwater member remains immersed.

Other objects, advantages and novel features of the present invention will be drawn from the following detailed embodiment of the present invention when taken in conjunction with the accompanying drawings.

DESCRIPTION OF THE PREFERRED EMBODIMENT

Figure 1:
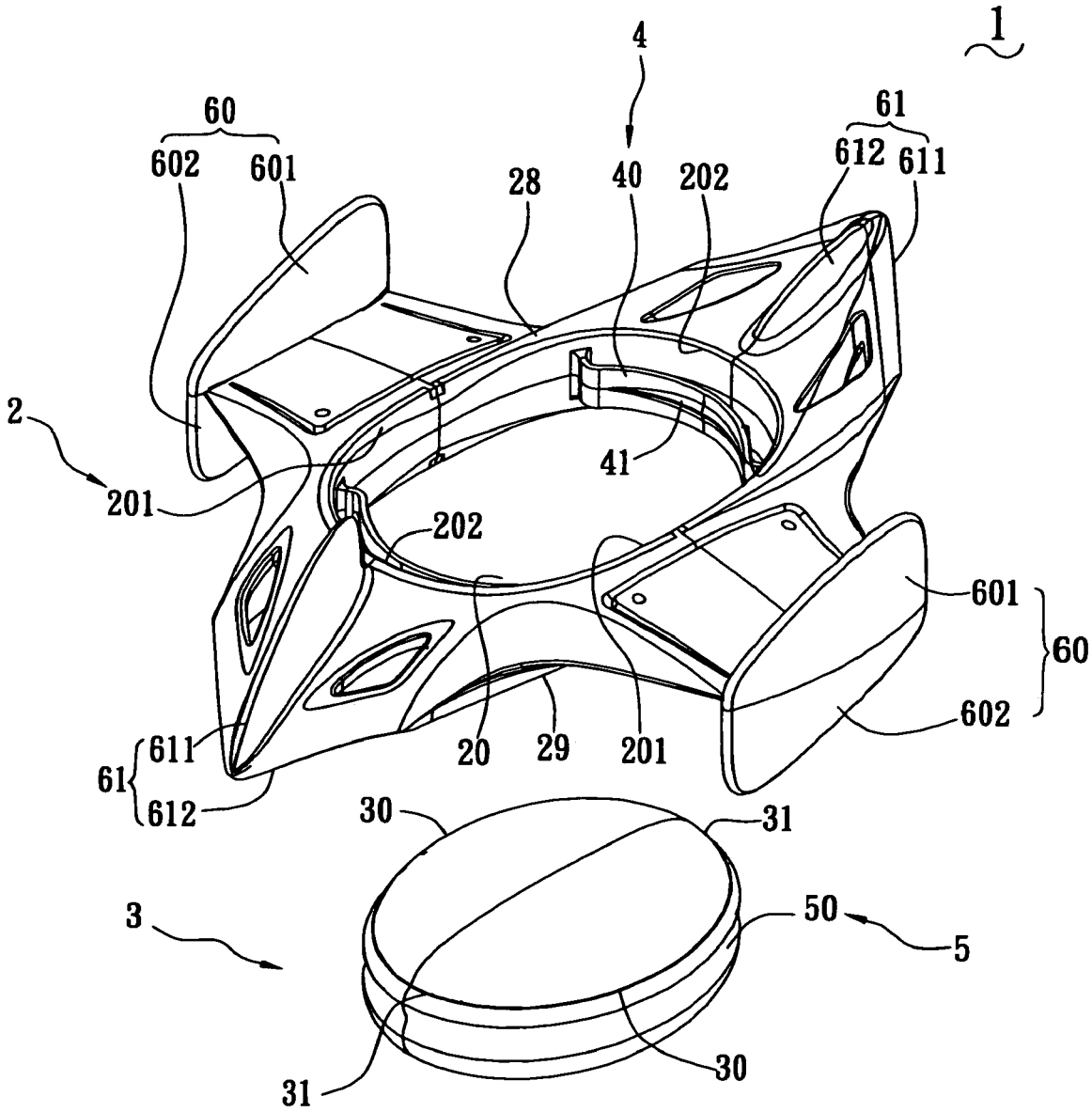
FIG. 1 is an exploded view of an aquatic fun toy of the present invention.
Figure 2:
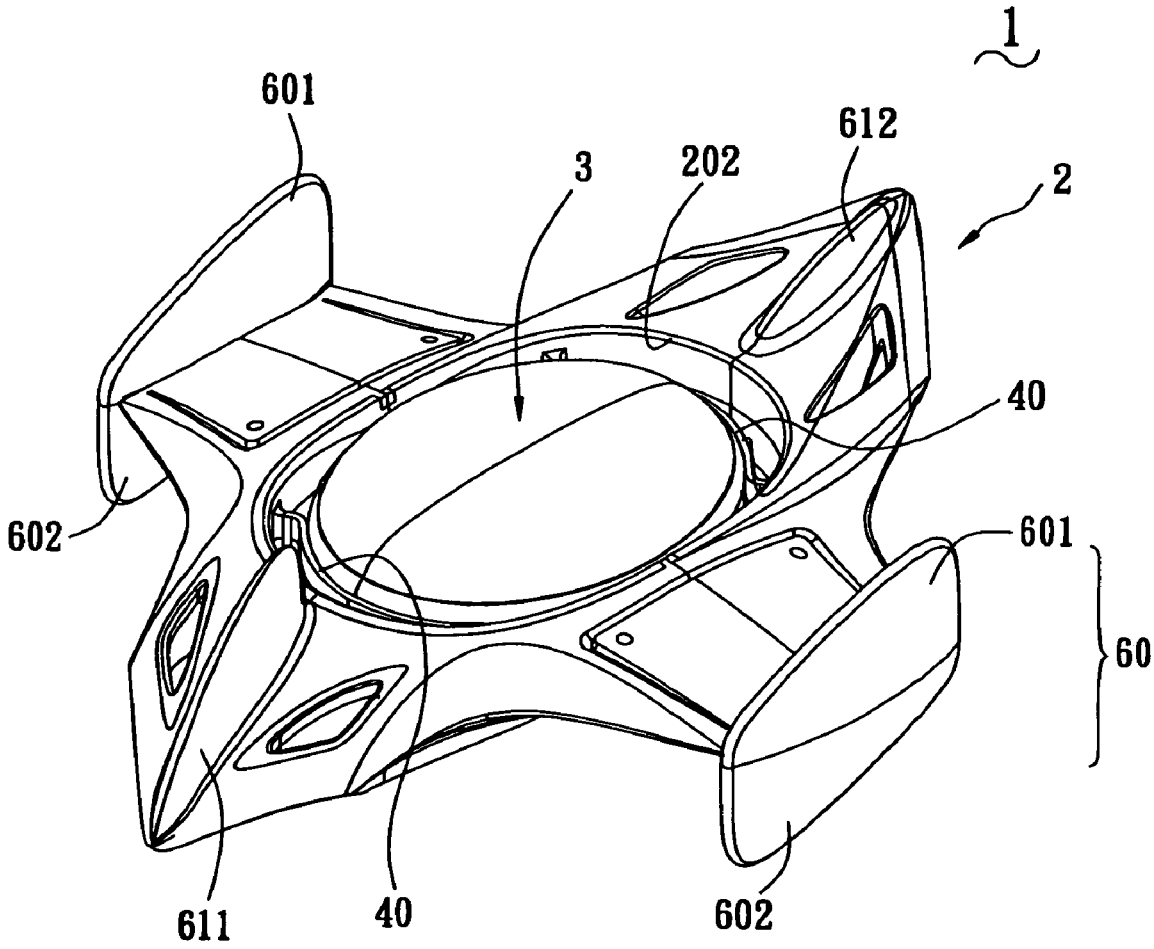
FIG. 2 is an assembled view of FIG. 1.
Figure 4:
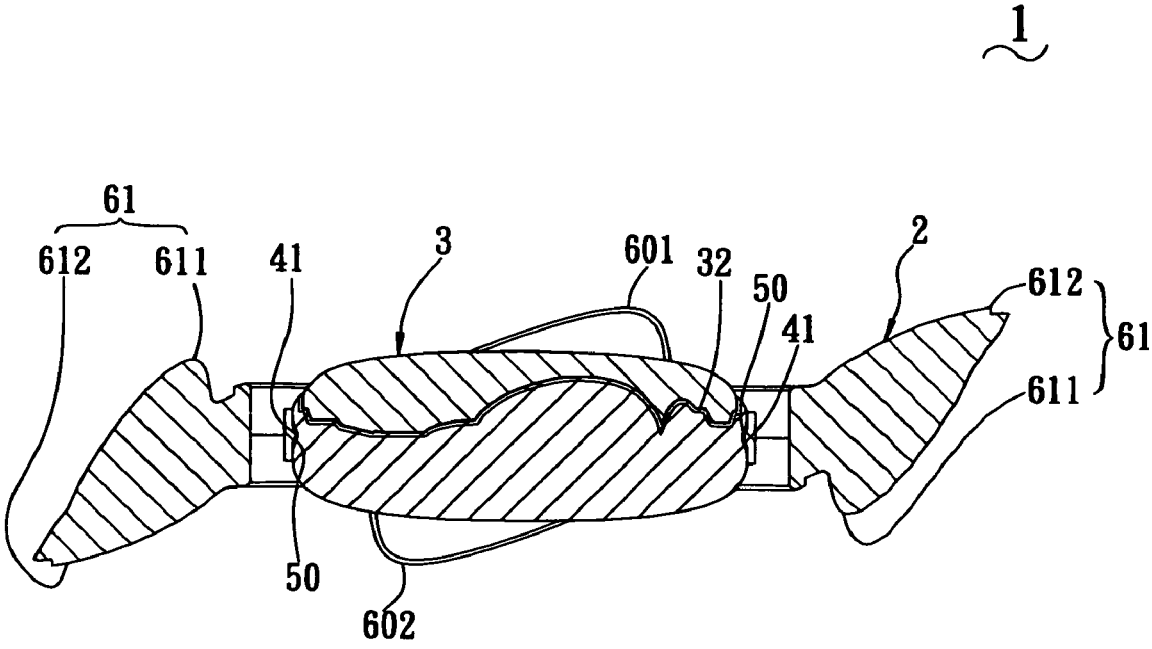
FIG. 4 is a cross-sectional view of FIG. 3 taken along line 4—4 in FIG. 3.

Referring to FIG. 1, an aquatic fun toy 1 of the present invention comprises a buoyant body 2, an underwater member 3, first and second engaging portion 4, 5 and a plurality of supporting portions 6. The buoyant body 2 is made from floatable material and may be in any symmetrical geometric shape. In this embodiment, the buoyant body 2 has an aircraft shape. The buoyant body 2 has an upper surface 28, a lower surface 29 and a receiving portion 20 communicating through the upper surface 28 and the lower surface 29. The receiving portion 20 is long cylindrical having long sides 201 and short sides 202. A plurality of supporting portions 60, 61 are positioned on the buoyant body 2 corresponding to the long sides 201 and short sides 202, wherein the supporting portions 60 includes upper parts 601 and lower parts 602 having same height and forms at airfoil shape. Referring to FIG. 4, the supporting portions 61 includes upper parts 611 and lower parts 612 which are staggeringly arranged at opposite sides thereof and forms at shapes of head and trail of an aircraft. The supporting portions 60, 61 have same height, thus when the aquatic fun toy 1 is immersed in water, such that supporting portions 60, 61 keep the aquatic fun toy 1 at a desired height above the bottom of water. The desired height is equal to the height of the supporting portions 6 and is large enough to disengage the underwater member 3 from the buoyant body 2 whereby the buoyant body 2 floats on the water. Furthermore, the supporting portions 60, 61 comprise a soft plastic covering for a better touch feeling.

The underwater member 3 is of a long cylindrical shape corresponding to the receiving portion 20 for being receivable in the receiving opening 20. The underwater member 3 is made from solid hard plastic which material with a specific gravity thereof larger than that of water is filled. The underwater member 3 has long sides 30 and short sides 31; the size of the long sides 30 and short sides 31 is slightly smaller than the receiving portion 20, thereby a gap T is formed between the long sides 30 of the underwater member 3 and the receiving portion 20 for easily assembling. Moreover, the underwater member 3 has a slot 32 on the middle thereof for stamping patterns thereon before the underwater member 3 taking shape, thereby causing a special visual impression when light shine in through the slot 32.

Figure 3:
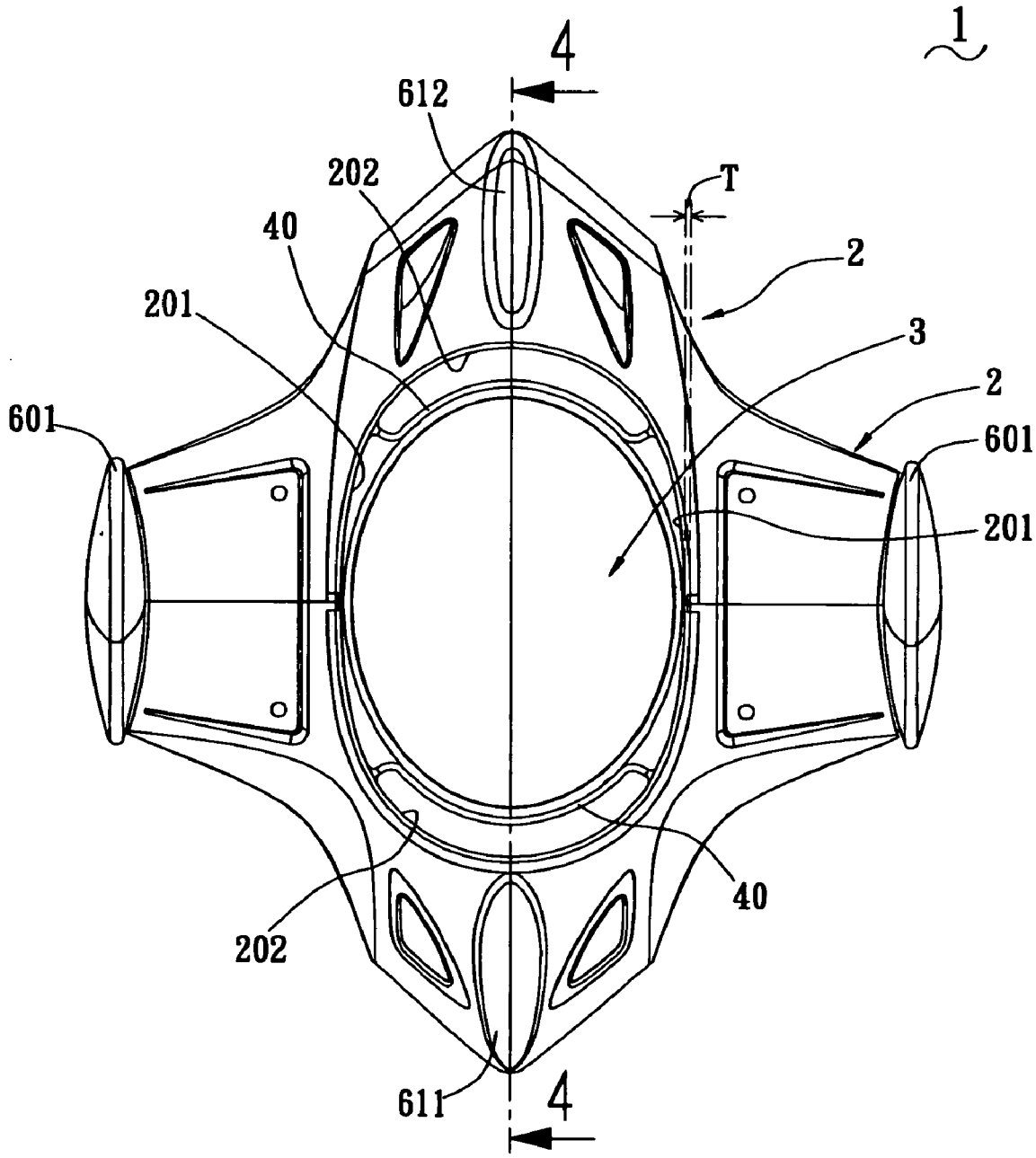
FIG. 3 is a top plan view of FIG. 2.

Referring to FIGS. 1, 3 and 4, the first engaging portion 4 formed on the short sides 202 of the receiving portion 20 and the second engaging portion 5 formed on the underwater member 3 being engageable or disengageable with the first engaging portion. The first engaging portion 4 comprises an engaging wall 40 which extends and spaces along the short sides 202 of the receiving portion 20 and is resilient. An arcuate projection 41 is integrally formed and protruded from inner side of the engaging wall 40 for easily engaging or disengaging with the second engaging portion 5. The second engaging portion 5 includes a groove 50 and wherein opposite side surfaces of the groove 50 are chamfered for facilitating and guiding to engage with the arcuate projection 41 of the engaging wall 40.

Further referring to FIGS. 1 and 3, in assembly, the underwater member 3 is received in the receiving portion 20 of the buoyant body 2 and engages the buoyant body 2 through the engagement between the first and second engaging portion 4, 5. Thus, the assembled buoyant body 2 and underwater member 3 sink in water and are kept a desired height above the bottom of the water through the supporting portions 6.

Figure 5:
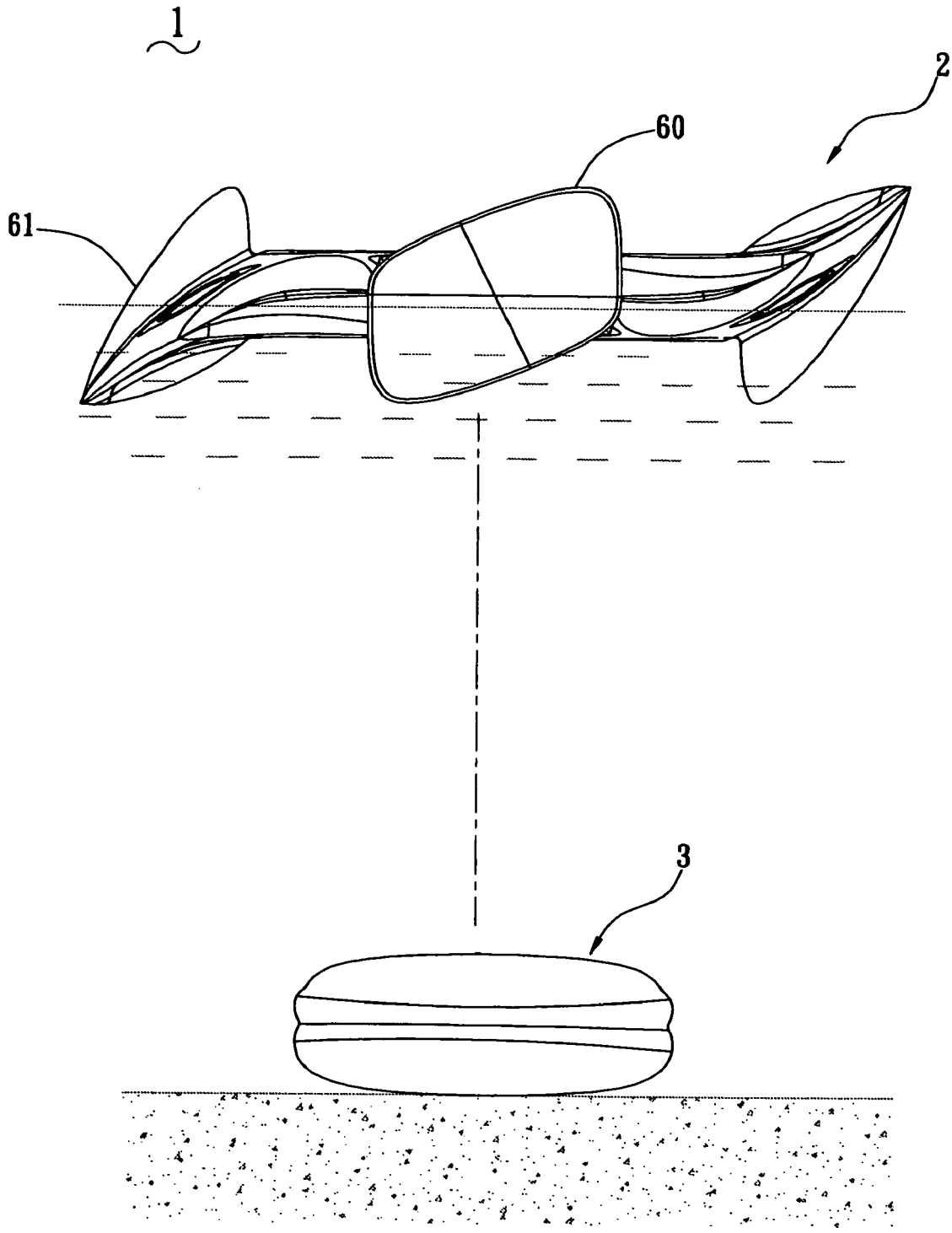
FIG. 5 is a schematic view showing a buoyant body floating on water after the buoyant body is disengaged from an underwater member.

In use, the assembled aquatic fun toy 1 is put underwater. Since the supporting portions 60, 61 symmetrically project from the upper and lower surface 28, 29 and have the same height, the aquatic fun toy 1 are kept the desired height from the bottom of the water whatever the upper surface 28 or the lower surface 29 faces the bottom of the water. Thus, players may dive into water from a start to look for the aquatic fun toy 1 and the one first finding the aquatic fun toy 1 may depress the underwater member 3 to disengage the second engaging portion 5 from the first engaging portion 4. Therefore, the buoyant body 2 floats on the surface of the water (see FIG. 5) and the underwater member 3 is immersed in water thereby to indicate the winner has come out. Accordingly, the aquatic fun toy 1 of the present invention can be used for a diving game and makes the game funny thereby can achieve the purpose of diving exercise.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. An aquatic fun toy for an aquatic game in water comprising:

a buoyant body having an upper and a lower surface, a receiving portion communicating through the upper and lower surface and a plurality of supporting portions having upper parts and lower parts for supporting the buoyant body at a predetermined height above a bottom of the water;

an underwater member selectively inserted in the receiving portion;

a first engaging portion formed in the receiving portion; and a second engaging portion formed on the underwater member being selectively connected to and separated from the first engaging portion;

wherein, when the buoyant body is connected with the underwater member and placed in the water, the plurality of supporting portions keep the buoyant body at a predetermined height above the bottom of the water, and when the underwater member is separated from the buoyant body, said buoyant body floats to a surface of the water and the underwater member sinks to the bottom of the water.

2. The aquatic fun toy as claimed in claim 1, wherein the upper part of each of the supporting portions has a different shape from the lower part thereof and wherein each of the upper parts and lower parts has a same height and respectively extends from the upper and lower surface of the buoyant body.

3. The aquatic fun toy as claimed in claim 2, wherein the height of each of the upper and lower parts of the supporting portions provides a distance for the underwater member to disengage from the buoyant body.

4. The aquatic fun toy as claimed in claim 3, wherein the receiving portion has an elliptical shaped interior surface.

5. The aquatic fun toy as claimed in claim 4, wherein the underwater member has an elliptical shape corresponding to the receiving portion.

6. The aquatic fun toy as claimed in claim 5, wherein an exterior of the underwater member is smaller than an interior of the receiving portion, thereby a gap is formed between long sides of the underwater member and the receiving portion.

7. The aquatic fun toy as claimed in claim 1, wherein the first engaging portion includes two engaging walls, one of the two engaging walls is located on each of two opposing ends of the receiving portions, each of the two engaging walls extends inwardly.

8. The aquatic fun toy as claimed in claim 7, wherein an arcuate projection is integrally formed with an protrudes from an inner side of each of the two engaging walls for selectively connecting to the second engaging portion.

9. The aquatic fun toy as claimed in claim 8, wherein the second engaging portion includes a groove and wherein top and bottom surfaces of the groove are chamfered for engaging the arcuate projection of each of the two walls.

10. The aquatic fun toy as claimed in claim 1, wherein the supporting portions of the buoyant body further comprise a soft plastic covering.

11. The aquatic fun toy as claimed in claim 10, wherein the underwater member is made from a rigid plastic material having a slot on the middle thereof.

12. The aquatic fun toy as claimed in claim 10, wherein the slot forming a pattern.

* * * * *